United States Patent [19]

Kronenberger

[11] Patent Number: 5,031,246

[45] Date of Patent: Jul. 16, 1991

[54] HEADWEAR WITH SIZE ADJUSTMENT FEATURE

[76] Inventor: Robert A. Kronenberger, c/o American Needle, 8240 N. Lehigh, Morton Grove, Ill. 60053

[21] Appl. No.: 487,609

[22] Filed: Mar. 2, 1990

[51] Int. Cl.[5] ..... A42B 1/04

[52] U.S. Cl. ..... 2/197; 2/183; 2/418

[58] Field of Search ..... 2/181, 183, 197, 417, 2/418, DIG. 10, DIG. 11, 177

[56] References Cited

U.S. PATENT DOCUMENTS

| | | | |
|---|---|---|---|
| 531,505 | 12/1894 | Brown | 137/223 |
| 805,750 | 11/1905 | Redgrave | 2/418 |
| 1,391,753 | 9/1921 | Baier . | |
| 2,673,349 | 3/1954 | Key . | |
| 3,713,640 | 1/1973 | Margan | 2/413 |
| 3,866,243 | 2/1975 | Morgan | 2/3 R |
| 4,872,218 | 10/1989 | Holt | 2/197 |
| 4,941,210 | 7/1990 | Konucik | 2/183 |

FOREIGN PATENT DOCUMENTS

| | | | |
|---|---|---|---|
| 594973 | 3/1960 | Canada | 2/183 |
| 3323 | of 1894 | United Kingdom | 2/183 |

*Primary Examiner*—Werner H. Schroeder
*Assistant Examiner*—Diana L. Biefeld
*Attorney, Agent, or Firm*—Wood, Phillips, Mason, Recktenwald & Van Santen

[57] ABSTRACT

A headwear article having an inverted cup-shaped crown for placement over the head of an individual, a band on the crown with a surface embracing the head of the individual wearing the headwear and an inflatable element on at least one of the crown and band for varying the effective diameter of the band surface.

22 Claims, 1 Drawing Sheet

HEADWEAR WITH SIZE ADJUSTMENT FEATURE

BACKGROUND OF THE INVENTION

1. Field of the Invention

This invention relates to headwear and, more particularly, to a headwear article that can be configured to accommodate a plurality of different head sizes.

2. Background Art

Human head sizes vary considerably. To accommodate all users, it has heretofore been necessary for purveyors of headwear to carry a wide range of sizes.

It is known to incorporate an adjustable feature into headwear so as to limit the number of different sizes that must be stocked. Several different ways of affording this adjustment are known. For example, it is known to provide an elastic band within the crown of the hat. This accommodates a limited range of sizes.

One problem with the use of an elastic band is that, when the crown is pliable, the elastic tends to collapse the crown and distort the configuration of the crown. Further, the elastic embraces a smaller head with a lesser force than it would a larger head.

Another prior art adjusting structure consists of two connectable strap ends carried by the lower edge of the crown. The ends may be selectively connected as through a belt-type connection or through a releasable pin and aperture arrangement to selectively reduce and enlarge the crown opening. The straps normally deform the crown configuration, particularly when the straps are connected so as to accommodate a small head size. Further, the adjustment can take place only in fixed increments. The user's head size may be such that one size may be too small and the next available size may be too large to comfortably accommodate the head.

Another known prior art structure employs an adjustable drawstring carried in a receptive sleeve within the crown. The user draws the string to produce a desired diameter and then ties the ends thereof to fix that diameter. This requires that the user take the headwear off, tie the drawstring ends and replace the headwear. There is no frame of reference that allows the user to make fine adjustments, either to a larger or smaller size. Consequently, it becomes a trial and error exercise, which is clearly inconvenient.

A further problem with the prior art structures, particularly those with fixed diameters at the bottom of the crown, is that the crown is relatively inflexible and the size of the opening at the bottom thereof is fixed. It is difficult to get a perfect head fit and consequently the user generally settles for a fit that is either too loose or too tight.

SUMMARY OF THE INVENTION

The present invention is specifically directed to overcoming the above-enumerated problems in a novel and simple manner.

It is the principal objective of the present invention to afford a headwear article that can accommodate a wide range of head sizes without altering the appearance of the headwear and which adjustment can be simply and conveniently carried out by the user. It is a further objective of the invention to afford a headwear piece that consistently and comfortably embraces the head of the user regardless of the head size.

More particularly, applicant's invention is a headwear article having an inverted cup-shaped crown for placement over the head of an individual, a band on the crown with a surface embracing the head of the individual wearing the headwear and an inflatable element on at least one of the crown and band for varying the effective diameter of the band surface.

The band has a first effective diameter. By inflating the element, the effective band diameter is varied.

The inflatable element can take any of a variety of different configurations. There can be individually spaced pads or a ring-shaped bladder, extending through at least 180°, and preferably through 360°.

Preferably, the bladder resides between a sweat band and an inside surface of the crown. Inflation of the bladder shifts the sweatband inwardly towards the center of the crown to reduce the effective diameter of the band. Alternatively, the sweatband consists of a plurality of layers and the bladder is captured operatively between the sweatband layers.

With the inventive structure, the head of the user is comfortably embraced by the band. The amount of inflation of the bladder can be controlled to produce a desired force on the user's head. At the same time, the bladder has inherent resiliency which adds to the user's comfort.

The bladder has an associated valve which allows for inflation and deflation thereof. A simple hand-held air pump, as commonly used to inflate/deflate footballs, basketballs, etc., can be employed to fill the bladder.

Alternatively, to facilitate inflation of the bladder, a pump can be integrally attached to the headwear article. In a preferred form, the pump can be formed as a cup-shaped/semispherical membrane disposed over a one-way valve opening. By collapsing the membrane, air or other fluid is forced into the bladder to effect inflation thereof. The membrane can be made to have a sufficiently low profile so as not to detract from the appearance of the headwear piece. The user can effect inflation with the headwear in place. This allows a desired pressure to be developed on the user's head by the band—that is, the user can feel the proper adjustment.

The inventive structure has utility in many different headwear industries. For example, it is particularly adaptable to baseball-style caps, but can be used in virtually all headwear having a crown which fits over the head of a user. The inventive structure is ideal when used in association with a flexible crown. The effective diameter of the crown is changed from the inside of the crown so that the external appearance of the flexible crown is unaffected by the diameter adjustment.

When the bladder is used in conjunction with a flexible crown, an additional dimension is added to the headwear. The outer surface of the crown can reconfigure with the bladder to conform to different size and shape wearer heads. As the wearer directs the crown over his or her head, the bladder and outer crown surface readily conform.

The bladder may be made from any of a variety of different materials. A preferred material is latex, however silicone rubber or vinyl can be used as well. In one form of the invention, the bladder is formed by strips of rubber material having a width on the order of ¾ of an inch and a length on the order of 24 inches. Two strips are placed face-to-face and the opposite joining edges are bonded, as by sonic welding or the use of an adhesive.

The bladder can be sewn directly to one or both of the sweat band and crown.

A conventional style cap can be retrofit with the inventive structure with minimal expense. The incorporation of the bladder can be accomplished quite simply.

DETAILED DESCRIPTION OF THE DRAWINGS

An exemplary piece of headwear is shown at 10 suitable for incorporation of the present invention. The headwear 10 depicted is a baseball-style cap, however, it should be recognized that the invention is useable in virtually all different styles of headwear having a continuous annular edge which embraces a user's head.

Figure 1:
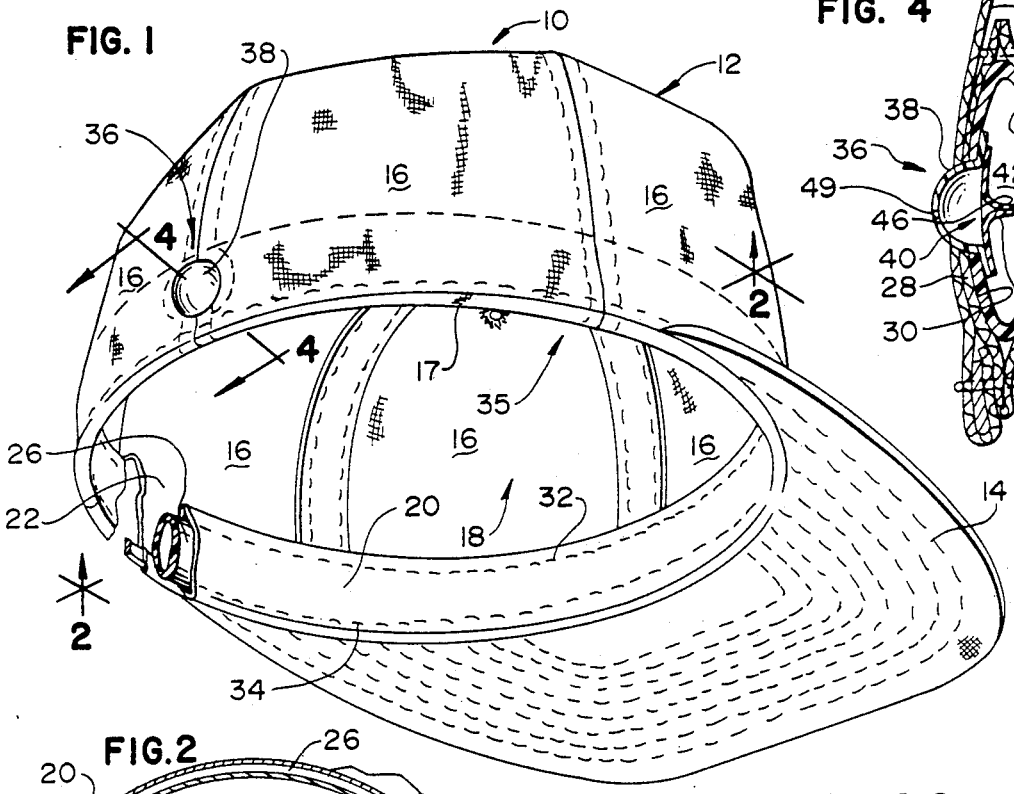
FIG. 1 is a bottom perspective view of a baseball-style cap with an inflatable bladder, according to the present invention, incorporated therein for size adjustment.
Figure 4:
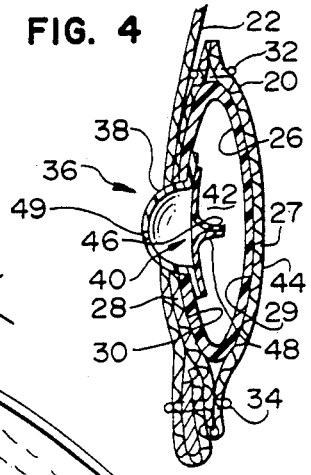
FIG. 4 is a section view of the cap and bladder taken along line 4—4 of FIG. 1.
Figure 2:
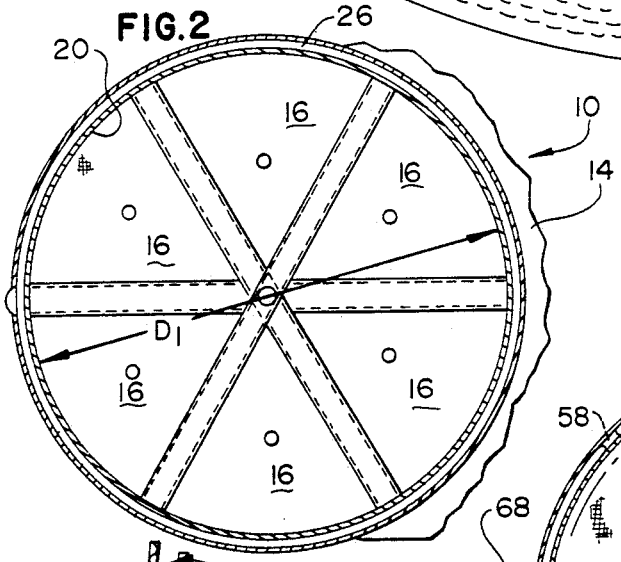
FIG. 2 is a reduced section view of the cap taken along line 2—2 of FIG. 1.

The cap 10, as shown in FIGS. 1, 2 and 4, consists of an inverted, cup-shaped crown 12 to which a bill/visor 14 is affixed to project forwardly therefrom. The crown 12 is defined by six fabric gores 16 sewn together along adjacent abutting edges. The lower edge 17 of the crown 12 defines an opening 18 to accommodate the user's head.

A continuous, annular sweatband 20 is sewn onto the inside surface 22 of the crown 12 adjacent the lower crown edge 17. The sweatband 20 is made from a moisture absorbent material to absorb perspiration from the user and shield the fabric crown 12 from the user's head to prevent perspiration stains as might discolor or otherwise detract from the appearance of the cap 10. An optional plastic layer (not shown) is interposed between the sweatband 20 and crown 12 to prevent migration of moisture from the sweatband 20 to the crown 12.

In a conventional baseball cap, the effective diameter of the crown 12 at the sweatband 20 determines the cap size. The diameter is characterized as the "effective" diameter because neither the crown opening 18 nor the human head is perfectly round. It is known to incorporate belt-type structures and/or elastic into a crown so as to selectively enlarge and diminish the effective diameter of the crown opening 18. The present invention is concerned with an alternative structure for effecting size adjustment of the crown opening 18.

Figure 3:
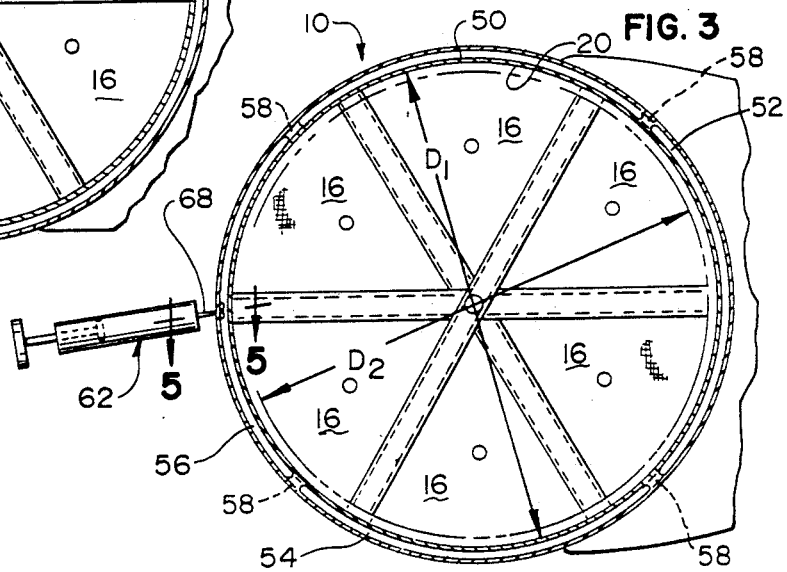
FIG. 3 is a section view of the cap, similar to that in FIG. 2, with an alternative form of bladder configuration.

In FIGS. 2 and 3, the effective diameter of the crown opening 18 is identified as dimension D1. The invention contemplates the provision of a flexible bladder 26 inside of the crown 12. In the embodiment of FIGS. 1, 2 and 4, the sweatband 20 consists of two fabric layers 27, 28. The bladder 26 is sandwiched between the facing surfaces 29, 30 on the layers 27, 28, respectively. Separate lines of stitching 32, 34, respectively on the top and bottom of the sweatband 20, secure the sweatband layers 27, 28 together and thereby captively maintain the bladder in the operative position of FIGS. 1 and 4. The lower line of stitching 34 extends into the crown 12 so that the sweatband 20 can be folded about the stitching line 34 selectively up into the space 35 bounded by the crown 12 against the crown surface 22 and away therefrom.

The bladder 26 is preferably made from a flexible material such as rubber, and preferably latex rubber. It could be made from other materials such as vinyl or any structure that is impermeable to air and readily expandable. The bladder 26 in FIGS. 1, 2 and 4 is formed as a single piece.

An inflation device/pump is integrated into the cap 10 at 36. The pump 36 consists of a semi-spherical diaphragm 38 which is collapsible to force a charge of air through a one-way valve 40 into the space 42 bounded by the bladder 26. Inflation of the bladder 26 causes the peripheral inside sweatband surface 44 to be collapsed towards the center of the crown opening 18, thereby resulting in a reduced effective diameter for the opening 18, designated D2 in FIG. 3.

The present invention contemplates numerous configurations for the pump 36 and one-way valve 40 in FIGS. 1, 2 and 4. The one-way valve 40 consists of two cooperating flexible flaps 46, 48, which are pressed into sealing engagement with each other by the fluid pressure internally of the bladder 26. By depressing the pump diaphragm 38, the flaps 46, 48 are forced apart by the incoming air pressure to admit air into the bladder space 42 to thereby effect expansion thereof. A bleeder port 49 allows the diaphragm 38 to spring back after it is depressed.

Figure 5:
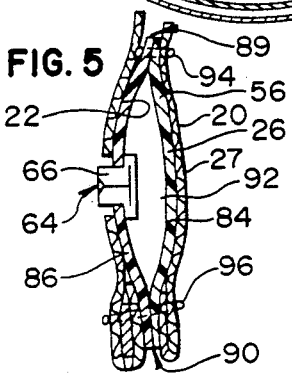
FIG. 5 is a section view of the cap and bladder taken along line 5—5 of FIG. 3.

The invention contemplates other variations of the structure shown in FIGS. 1, 2 and 4. In FIGS. 3 and 5, a modified bladder configuration is shown. In FIG. 3, individual bladder segments 50, 52, 54, 56 are captured directly between the outer sweatband layer 27 and inside surface 22 of the crown 12. Each of the bladder segments 50, 52, 54, 56 extends through slightly less than 90° so that all four sections 50, 52, 54, 56, which are equidistantly spaced, cooperatively extend through approximately 360°. Communication between adjacent sections 50, 52, 54, 56 is effected through conduits 58, which may be simple tubes. The invention contemplates the use of one or more of the segments 50, 52, 54, 56. For example, it is possible to incorporate only one segment 50, 52, 54, 56 or to incorporate only two of the diametrically opposed bladder segments 50, 52, 54, 56. Inflation of two opposite segments causes reduction of the effective diameter of the opening 18 and a relatively balanced force embracing the user's head.

The embodiment in FIG. 3 also employs an external hand-operated pump 62. A one-way valve 64, of the type conventionally used to inflate/deflate sports balls, such as footballs, basketballs, beach balls, etc. is incorporated into the bladder 26 at the rear of the cap 10. The valve 64 has a fitting 66 to releasably connect to a cooperating fitting 68 on the pump 62. The hand operated pump 62 is also of conventional construction. A pressurized supply of air could also be used to inflate the bladder sections 50, 52, 54, 56.

Figure 6:
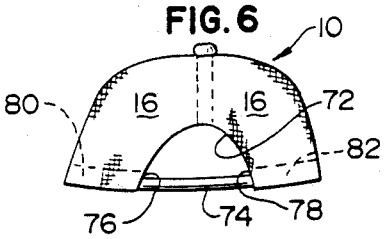
FIG. 6 is a reduced, rear elevation view of the cap with an elastic strap incorporated therein.

A further modification of the cap 10 is shown in FIG. 6. In FIG. 6 a cut-out 72 is provided at the rear of the cap 10. An elastic band 74 spans the distance between the free edges 76, 78 at the bottom of the crown 12 and resiliently draws the edges 76, 78 towards each other to diminish the width of the cut-out 72. This arrangement can be used in conjunction with bladder segments 80, 82, similar to those 50, 52, 54, 56, incorporated into the crown 12, as previously described.

A further variation in the structure in FIGS. 3 and 5 involves the bladder 26. The bladder 26 is formed by two flat sheets 84, 86 on the order of ¾" in width and 24" in length. The opposite edges 89, 90 of the sheets 84, 86 are sonically welded, bonded with an adhesive, or otherwise joined to define a leakproof chamber 92. Separate lines of stitching 94, 96 respectively secure the sweatband layer 20 to the bladder 26 and the bottom bladder edge 90 to the crown 12. The top edge 89 of the bladder 26 could be secured to the crown 12, though it preferably is not so as to allow the sweatband layer 20 to fold away from the crown surface 22 as the bladder 26 is inflated.

With the inventive structure, it is possible for the user to place the cap 10 on his or her head. The integral pump 38 can then be operated with the cap 10 in place to adjust the diameter of the cap opening 18 to comfortably fit the user's head. The bladder 26, in addition to allowing variation in the diameter of the cap opening 18, provides a cushioned fit around the head of the user adding considerably to the comfort of the user. The elastic band 74 in FIG. 6 also exerts a slight bias around the head of the user to maintain the cap 10 in place on the user's head.

The flexible nature of the crown allows it to reconfigure with the bladder 26 to conform in a radial direction to different size and shape wearer heads. The headwear piece readily automatically conforms as the crown is pressed over the wearer's head.

It can be seen that the inventive structure can be simply and economically incorporated into a conventional-style cap. It can also be retrofit into conventional caps.

The foregoing disclosure of specific embodiments is intended to be illustrative of the broad concepts comprehended by the invention.

I claim:

1. A headwear piece comprising:

an inverted cup-shaped crown for placement over the head of a wearer, said crown having at least a part thereof made from a flexible element that extends around the head of a wearer with the headwear piece in place on a wearer's head and defines within the crown a first effective diameter, said crown having an outer surface defined at least partially by said flexible element;

at least one inflatable element that can be inflated to an expanded state and deflated to a collapsed state;

means for connecting the inflatable element to the crown at the part thereof made from the flexible element so that with the inflatable element in its expanded state the crown and flexible element cooperatively define a second effective diameter for embracing the head of a wearer that is smaller than the first effective diameter, whereby a wearer's head in the crown surrounded by the flexible part is cushioned by both the inflatable element and the flexible element, said outer surface and inflatable element both being able to reconfigure in a radial direction to accommodate different size and shape wearer heads.

2. The headwear piece according to claim 1 wherein said inflatable element comprises an inflatable bladder.

3. The headwear piece according to claim 2 including a band on the crown with a surface for embracing the head of an individual wearing said headwear piece, wherein said band consists of first and second layers and the inflatable element resides between the first and second band layers.

4. The headwear piece according to claim 2 wherein the bladder defines a ring shape that extends through 360° for substantially entirely surrounding the head of a wearer.

5. The headwear piece according to claim 2 wherein said bladder is made from a rubber material.

6. The headwear piece according to claim 2 wherein said bladder is made from a latex material.

7. The headwear piece according to claim 2 wherein said bladder is sewn to at least one of the crown and band.

8. The headwear piece according to claim 2 wherein said bladder has a width of approximately ¾ inch.

9. The headwear piece according to claim 1 wherein said inflatable element comprises a curved, inflatable bladder, said bladder defining a ring shape extending through approximately 360° to substantially entirely surround a wearer's head with the headwear piece in place on the wearer's head.

10. The headwear piece according to claim 1 including a pump means for inflating the inflatable element and means for attaching the pump means to said crown.

11. The headwear piece according to claim 10 including means for attaching the pump means integrally to the crown.

12. The headwear piece according to claim 1 including means in addition to said inflatable element for varying the first effective diameter.

13. The headwear piece according to claim 1 wherein said crown has a bottom edge, there is a band on said crown, and said band is connected to said crown adjacent to said bottom edge and folded inside of a space bounded by said crown.

14. The headwear piece according to claim 3 wherein said crown has an inside surface, the band is connected to said crown and the inflatable element comprises a bladder residing at least partially between the inside crown surface and at least a part of the band.

15. The headwear piece according to claim 1 including a valve means on said inflatable means for selectively inflating and deflating said inflatable element.

16. The headwear piece according to claim 1 wherein said inflatable element comprises a bladder and the bladder includes a one-way valve means for introducing a fluid into the bladder to effect inflation thereof.

17. The headwear piece according to claim 1 wherein said headwear piece comprises a baseball-type cap with a bill connected to said crown.

18. A headwear piece comprising:

an inverted cup-shaped crown for placement over the head of a wearer, said crown being made from a collapsible material such as cloth and having an outer surface;

a bill/visor connected to the crown;

a sweat band on the crown with a surface for embracing the head of an individual wearing said headwear piece, said sweat band surface having a first, effective diameter to fit a predetermined head size;

an inflatable bladder;

means for attaching the inflatable bladder to at least one of the crown and sweat band so that the bladder resides between the sweat band and the crown, said inflatable bladder having an arcuate configuration for conforming to the shape of a user's head and extending through an arc of at least 180°; and means for selectively inflating the bladder with a fluid and deflating the bladder to alter the effective diameter of the sweat band surface, said inflatable bladder being arranged against the flexible crown so that both the inflatable bladder and outer crown surface can reconfigure in a radial direction to accommodate different size and shape wearer heads.

19. The headwear piece according to claim 18 in combination with a pump means for inflating the bladder and means for integrally connecting the pump means to at least one of the crown and sweat band.

20. The headwear piece according to claim 18 wherein the sweat band comprises a cloth material.

21. A headwear piece comprising:

a crown defining an opening for reception of the head of a wearer, said crown having at least a part thereof made from flexible material that extends around the head of the wearer with the headwear piece in place on a wearer's head and defines a crown opening with a first effective diameter, said crown having an outer surface defined at least partially by said flexible part;

a resilient, expandable bladder for reception of a fluid; and means for connecting the resilient bladder to the crown at the flexible part thereof so that with the bladder filled with a first quantity of fluid the bladder and flexible crown part cooperatively define a crown opening with a second effective diameter and with the bladder filled with a quantity of fluid greater than said first quantity, the bladder and flexible crown part cooperatively define a crown opening with a third effective diameter that is smaller than the second effective diameter, whereby a wearer's head extending through the crown opening is surrounded and cushioned by both the flexible crown part and the bladder, said crown outer surface and bladder both being able to reconfigure in a radial direction to accommodate different size and shape wearer heads.

22. The headwear piece of claim 21 in combination with a pump means for directing fluid into the bladder and means for integrally connecting the pump means to the crown so that a wearer can adjust the crown size with the crown in place on a wearer's head.

* * * * *